US010996034B2

(12) United States Patent
Wustlich et al.

(10) Patent No.: US 10,996,034 B2
(45) Date of Patent: May 4, 2021

(54) IRRITATION MEMBER

(71) Applicant: Rheinmetall Waffe Munition GmbH, Unterluess (DE)

(72) Inventors: Martin Wustlich, Luedersdorf (DE); Frank Habel, Hohnstorf (DE); Kai Luebbers, Kudderwoerde (DE); Julia Heering, Trittau (DE); Philip Weber, Trittau (DE); Kolja Garber, Bad Oldesloe (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 16/900,545

(22) Filed: Jun. 12, 2020

(65) Prior Publication Data

US 2020/0309493 A1 Oct. 1, 2020

Related U.S. Application Data

(63) Continuation of application No. PCT/EP2018/079143, filed on Oct. 24, 2018.

(30) Foreign Application Priority Data

Dec. 12, 2017 (DE) ..... 10 2017 129 643.3

(51) Int. Cl.
*F42B 12/42* (2006.01)
*F42B 27/00* (2006.01)

(52) U.S. Cl.
CPC ..... *F42B 12/42* (2013.01); *F42B 27/00* (2013.01)

(58) Field of Classification Search
CPC ..... F42B 27/00; F42B 8/26
See application file for complete search history.

(56) References Cited

U.S. PATENT DOCUMENTS

| | | | | |
|---|---|---|---|---|
| 9,016,205 | B2 | 4/2015 | Lübbers et al. | |
| 9,016,888 | B2 * | 4/2015 | Glynn | H05B 41/34 362/208 |
| 2008/0276822 | A1 * | 11/2008 | Lubbers | F42B 12/46 102/502 |
| 2010/0072895 | A1 | 3/2010 | Glynn et al. | |
| 2016/0069924 | A1 | 3/2016 | Norris et al. | |
| 2016/0356438 | A1 | 12/2016 | Matson | |
| 2017/0102219 | A1 * | 4/2017 | Grassi | F42B 27/00 |

FOREIGN PATENT DOCUMENTS

| | | |
|---|---|---|
| DE | 10 2010 052 210 A1 | 5/2012 |
| EP | 3 023 731 A1 | 5/2016 |

* cited by examiner

*Primary Examiner* — J. Woodrow Eldred
(74) *Attorney, Agent, or Firm* — Muncy, Geissler, Olds & Lowe, P.C.

(57) ABSTRACT

An irritation member having a housing, wherein the housing has a front side and a rear side, as well as lateral surfaces connecting the front side and the rear side. The front side and rear side are larger than the lateral surfaces, thereby producing a parallelepipedal housing. The irritation member has blow-out openings on the lateral surfaces and an actuation element that is provided in a recess of the housing. In the event of non-actuation, the actuation element is thereby received in the recess of the housing and thus does not increase the size of the housing. As a result, the irritation member does not look like a conventional irritation member.

18 Claims, 1 Drawing Sheet

IRRITATION MEMBER

This nonprovisional application is a continuation of International Application No. PCT/EP2018/079143, which was filed on Oct. 24, 2018, and which claims priority to German Patent Application No. 10 2017 129 643.3, which was filed in Germany on Dec. 12, 2017, and which are both herein incorporated by reference.

BACKGROUND OF THE INVENTION

Field of the Invention

The present invention relates to a stun grenade, such as those used by security forces and the army. Stun grenades ensure visual and acoustic effects through the deployment of active charges and thereby ensure disorientation when corresponding threats exist.

The active charges deployed by the stun grenades activate the corresponding effects by burning off or breaking down the active charges. If an active charge is able to produce the corresponding acoustic and/or visual effects during this, the active charge is also described as an effect charge.

Description of the Background Art

Corresponding stun grenades are known from the prior art. Hence, for example, DE 10 2010 052 210 A1, which corresponds to U.S. Pat. No. 9,016,205, and which discloses a corresponding stun grenade having a detonator head, an actuating element, and blowout openings from which the effect of the stun grenade can be produced.

Corresponding stun grenades are frequently configured as hand-operated devices, for example as manually launched projectiles.

These manually launched projectiles are usually similar in shape and resemble hand grenades. Accordingly, stun grenades of this kind can be identified prior to activation and countermeasures can be taken where necessary, as a result of which the impact of the stun grenade is lessened.

SUMMARY OF THE INVENTION

It is therefore an object of the present invention to provide a stun grenade which does not give the external impression of being a grenade or a hand-launched stun grenade. A further problem is that of designing the stun grenade in such a manner that it can be stored as easily as possible and is easy to handle.

Therefore, in an exemplary embodiment, the present invention proposes a stun grenade which has a housing, wherein the housing has a front side and a rear side and also side faces which connect the front and rear sides. In this way, a flat stun grenade should be created, the size of which is such that it can easily be handled. Due to its design as a flat body, the stun grenade can easily be used and this atypical design means that it is not immediately recognizable as a stun grenade. In a particular embodiment, the stun grenade has a parallelepipedal design.

This stun grenade also has at least one blowout opening. These blowout openings can be arranged on the side faces. This means that the effect of the stun grenade can be produced upwardly, downwardly and on the sides.

Furthermore, the stun grenade has at least one effect charge which can produce acoustic and/or visual effects through burn-off or decomposition. The stun grenade according to the invention is preferably configured as a sound-and-flash stun grenade.

In order for it to be activated, the stun grenade has an actuating element and at least one detonator head. The detonator head in this case ensures that a primer cap is struck or activated and the effect charge can therefore be burned off. Likewise, the primer cap can cause a delay charge to burn off, wherein an over-detonation to the effect charge and therefore conversion of the effect charge then takes place. Alternatively, a bursting charge may be detonated which causes the decomposition of the effect charge. During this burn-off or decomposition, the aforementioned visual and acoustic effects are created and deployed through the blowout openings.

The actuating element may be a manual actuation, although electrical or remote-controlled operating elements are also conceivable. In a preferred embodiment, it is proposed that the actuating element should be configured as a lever, as a result of which the stun grenade according to the invention is handled in the same way as stun grenades known from the prior art. The actuating element may, however, also bring about production of the effects via an electrical impulse or in a time-delayed manner. For remote-controlled actuation, the stun grenade must have corresponding radio transmission means.

A recess can be provided in the housing which can hold the actuating element. Where the lever is embodied as the actuating element, the lever is thereby received at least partially in the receiving means in the non-actuated state. In a preferred embodiment, this receiving takes place completely. This is achieved in that the outer dimensions of the housing are not enlarged by the actuating element. This additionally helps create a compact design and means that the parallelepipedal appearance of the stun grenade is not changed.

At least one cylindrical chamber can be provided in the housing which can receive at least one effect charge. The stun grenade is then configured in such a manner that when multiple effect charges are used, these are introduced into a cylindrical chamber and consequently deployed consecutively during burn-off or decomposition of the effect charges. However, an individual cylindrical chamber may also be provided in the housing for each effect charge. In the aforementioned embodiment, deployment can then take place simultaneously if each effect charge is provided with its own blowout opening.

These different possible configurations make it conceivable for the stun grenade to be configured in such a manner that the multiple effect charges are burned off consecutively or simultaneously. Combinations are also conceivable, depending on the configuration of the stun grenade.

In order to prevent the effect charges from being exposed to moisture during storage of the finished stun grenades, it is proposed that the blowout openings should be closed by means of bursting membranes. Bursting membranes of this kind are known from the prior art and can tightly seal openings. In this way, the stun grenades can be stored until they are used without this having any detrimental effect on their operation. During the decomposition or burn-off of the effect charges, pressure develops in the corresponding cylindrical chambers, which causes the bursting membrane to rupture and clear the blowout openings for deployment of the effects.

At least one delay charge can be arranged in the housing. The delay charge ensures that following actuation of the actuating element, the burn-off or decomposition of the effect charges takes place in a time-delayed manner. Hence, the delay charge is initially detonated by the detonator head, which likewise offers a certain time delay due to burn-off, until the effect charges are then detonated by the delay charge.

The aforementioned delay charge can be provided according to the invention in a cross-chamber in the housing which is connected to at least one cylindrical chamber. This cross-chamber then runs transversely to the cylindrical chambers. In this way, the delay charge can bring about the over-detonation of the effect.

Also, multiple cross-chambers can be provided to receive multiple delay charges. In this way, a time control of the individual effect charges in the stun grenade can be achieved. Deployment of the individual effect charges can thereby take place in multiple stages in a time-delayed manner.

The detonator head can have a primer cap. The primer cap is in turn activated by the actuating element. In the embodiment of the lever, said lever actuates the primer cap which in turn ensures detonation of the effect charges, the burster charge or the delay charges.

The detonator head itself can be integrated in the housing according to the invention, so that the dimensions of the housing are in turn unchanged. In a separate embodiment, however, the detonator head may also be arranged on a side face, wherein it is proposed for this purpose that the detonator head exhibits the same housing depth. This means that the detonator head projects laterally or upwardly or downwardly from the housing. The depth of the housing is not changed by this, however.

In order to secure the stun grenade, a safety pin can be provided which is inserted at least sectionally into the housing and/or the detonator head. The safety pin prevents operation of the actuating element and therefore accidental detonation and deployment of the effects. It is furthermore proposed that a safety ring should be attached to the safety pin, so that the safety pin is configured to be removable from the safety position in the conventional manner. Removal makes it possible to operate the actuating element. Following removal of the safety pin by the safety ring, the actuating element can be functionally used to bring about deployment of the effects.

For the front and rear sides of the housing which are of flat design, it is proposed that at least one label field should be provided. In this case, the corresponding effect can be applied to the label fields and also specific data relating to the stun grenade. In this way, it is possible to see from the outside which effect and operation the stun grenade provides.

Giving the stun grenade a parallelepipedal design should mean that it does not look like a stun grenade and is therefore not identified as such prior to activation and prior to deployment of the effects. Instead, this design makes the stun grenade look like a mobile phone.

In order to achieve this visual effect, it is proposed according to the invention that the depth of the housing should correspond to less than half the width of the housing. Likewise, it is proposed that the width of the housing should correspond to less than half the height of the housing.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
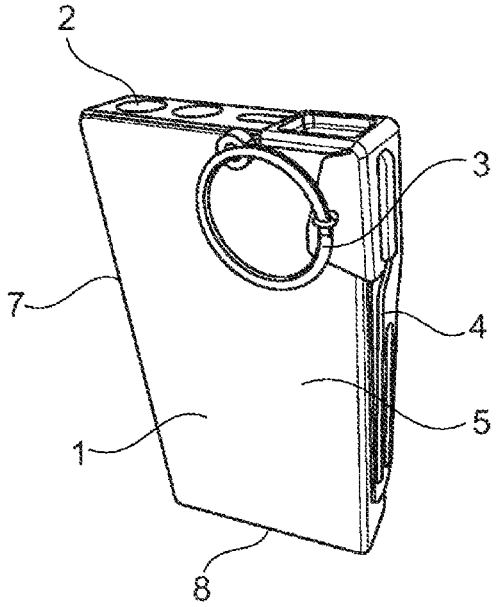
FIG. 1: shows a perspective view of a stun grenade according to the invention with a detonator head integrated in the housing.

FIG. 1 shows a perspective representation of a stun grenade according to the invention having a housing 1, wherein the housing 1 has a front side and a rear side. The front and rear sides are each connected to one another via side faces in all four directions, wherein the side faces are very much smaller than the front and rear sides. The front and rear sides are larger in design than the side faces according to the invention.

The stun grenade according to the invention furthermore has at least one blowout opening 2 arranged on the side faces. This means that the blowout openings 2 can be arranged in all four directions of the side faces.

The stun grenade furthermore has an actuating element which is designed as a lever 4 in this case. For this purpose, the stun grenade has a recess in the housing 1 in which the actuating element can be received.

In the non-operated state, the actuating element is therefore received in the recess during non-actuation, so that the lever 4 does not project beyond the outer dimensions of the housing and does not therefore increase the dimensions. In this way, the lever 4 is not immediately discernible as an actuating element and the shape of the stun grenade is not changed by the actuating element. When the lever 4 is actuated, it is raised from the side face on the side.

The stun grenade also has a detonator head 6 which is integrated in the FIG. 1 in the housing 1. In order to guard against accidental actuation of the actuating element, a safety pin is provided which, through the detonator head 6 being arranged in the housing 1, can likewise be inserted into the housing 1. The safety pin can be pulled out by a safety ring 3 and thereby make the actuating element actuable.

It is proposed that the stun grenade according to the invention should be provided with a label field 5, preferably on the front and/or rear side(s) of the stun grenade. The label field 5 enables functionally specific data to be applied, so that this information can be made available to the user of the stun grenade as quickly as possible.

Figure 2:
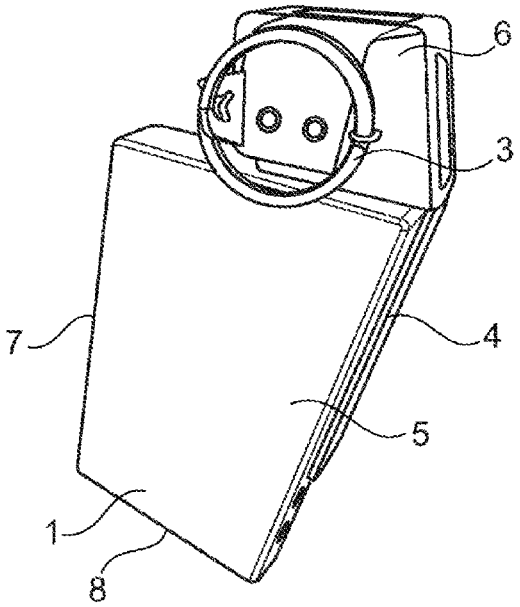
FIG. 2: shows a perspective view of a stun grenade according to the invention with the detonator head attached to the side.

FIG. 2 shows a similar stun grenade according to the invention wherein, however, the detonator head 6 is attached to a side face of the stun grenade in this case. This means that the height 7 of the housing 1 is changed but not the remaining dimensions such as width 8 or depth.

According to the invention, the stun grenade has a height 7, a width 8, and according to the design, a depth. The height 7 in this case is the longest side of the parallelepipedal housing 1 and the width 8 is the side running transversely to the height 7. The width 8 is of such a size that it is smaller than half the height 7. The depth is in turn of such a size that it is smaller than half the width 8.

When using a detonator head 6 attached to the side face, it is proposed that said detonator head 6 should likewise be provided with the same depth as the housing 1, but in any event that a depth should be used which is no greater than the depth of the housing 1. It should thereby be achieved that the depth is not increased and therefore a different optical impression of the stun grenade results.

With these embodiments and the aforementioned sizing, the proposed stun grenade is not immediately identifiable as such and its shape means that it is easy to handle and compact.

The invention is not limited to the aforementioned features. Instead, further embodiments are conceivable. Hence, a modular design could be possible in which the detonator head is only placed on the housing during use. A corresponding interface between the detonator head and the housing must then be provided. Furthermore, it is conceivable for electrical detonation to be used in the detonator head rather than the primer cap.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A stun grenade comprising:

a housing;

at least one blowout opening;

an actuating element;

at least one effect charge; and at least one detonator head, wherein the housing has a front and a rear side and also side faces which connect the front and rear sides, wherein the housing has a parallelepipedal design, and wherein the at least one blowout opening is arranged on one of the side faces.

2. The stun grenade as claimed in claim 1, wherein a recess is provided in the housing in which the actuating element is adapted to be received at least partially.

3. The stun grenade as claimed in claim 1, wherein at least one cylindrical chamber is provided in the housing which can receive the at least one effect charge.

4. The stun grenade as claimed in claim 3, wherein a respective one of the at least one cylindrical chamber is provided in the housing for each respective one of the at least one effect charge.

5. The stun grenade as claimed in claim 1, wherein the at least one effect charge produces flash and/or bang effects.

6. The stun grenade as claimed in claim 1, wherein the at least one blowout opening is closed by bursting membranes.

7. The stun grenade as claimed in claim 1, wherein at least one delay charge is arranged in the housing.

8. The stun grenade as claimed in claim 7, wherein at least one cross-chamber is provided in the housing which receives the at least one delay charge and is connected to at least one cylindrical chamber.

9. The stun grenade as claimed in claim 1, wherein the at least one detonator head has a primer cap which is activated by the actuating element.

10. The stun grenade as claimed in claim 1, wherein the actuating element is configured as a lever.

11. The stun grenade as claimed in claim 1, wherein the at least one detonator head is integrated in the housing.

12. The stun grenade as claimed in claim 1, wherein the at least one detonator head is arranged on a side face and has the same depth as the housing.

13. The stun grenade as claimed in claim 1, wherein a safety pin is provided which can be pulled out by a safety ring.

14. The stun grenade as claimed in claim 1, wherein a label field is provided on the housing.

15. The stun grenade as claimed in claim 1, wherein the depth of the housing corresponds to less than half the width of the housing.

16. The stun grenade as claimed in claim 1, wherein the width of the housing corresponds to less than half the height of the housing.

17. The stun grenade as claimed in claim 1, wherein a recess is provided in a side face of the housing, wherein the actuating element is accommodated in the recess such that the actuating element does not project beyond outer dimensions of the housing.

18. The stun grenade as claimed in claim 1, wherein the front and rear sides of the housing are larger than the side faces.

* * * * *